US007127900B2

(12) United States Patent
Yoshimura et al.

(10) Patent No.: US 7,127,900 B2
(45) Date of Patent: Oct. 31, 2006

(54) METHOD AND APPARATUS FOR PRODUCING ICE CONTAINING OZONE

(75) Inventors: Kenji Yoshimura, Kitakyushu (JP); Hiromi Yamamoto, Fukuoka (JP)

(73) Assignee: Fukuoka Prefectural Government Of, Fukuoka (JP)

( * ) Notice: Subject to any disclaimer, the term of this patent is extended or adjusted under 35 U.S.C. 154(b) by 112 days.

(21) Appl. No.: 10/978,488

(22) Filed: Nov. 2, 2004

(65) Prior Publication Data

US 2006/0090473 A1 May 4, 2006

(51) Int. Cl.
*F25C 1/18* (2006.01)

(52) U.S. Cl. ..... 62/69; 62/1; 62/340; 62/356

(58) Field of Classification Search ..... 62/66–74, 62/340–356, 1
See application file for complete search history.

(56) References Cited

U.S. PATENT DOCUMENTS 3,959,981 A * 6/1976 Anderson ..... 62/135
4,393,660 A * 7/1983 Kleiner et al. ..... 62/69
5,076,069 A * 12/1991 Brown ..... 62/308
6,334,328 B1 * 1/2002 Brill ..... 62/347
6,506,428 B1 * 1/2003 Berge et al. ..... 426/66
6,666,030 B1 * 12/2003 Furuta et al. ..... 62/1

FOREIGN PATENT DOCUMENTS

| | | |
|---|---|---|
| JP | 58-142176 | 8/1983 |
| JP | 8-27111 | 3/1996 |
| JP | 9-105570 | 4/1997 |
| JP | 10-267476 | 10/1998 |
| JP | 2000-39239 | 2/2000 |
| JP | 2000-81261 | 3/2000 |
| JP | 2002-162136 | 6/2000 |
| JP | 2003-262441 | 9/2003 |

* cited by examiner

*Primary Examiner*—William E Tapolcai
(74) *Attorney, Agent, or Firm*—Westerman, Hattori, Daniels & Adrian, LLP.

(57) ABSTRACT

A method and apparatus 10 for producing ice containing ozone by injecting ozonated water in which ozone is dissolved or suspended into a cylindrical-shaped container 14 provided with an airtight lid 12 at one side of the container 14, and by cooling down the ozonated water injected into the cylindrical-shaped container 14 in a pressurized state to generate finer bubbles containing the ozone by freezing the ozonated water. The method and apparatus make it possible to produce ice containing ozone in which the ozone is sealed in a higher percentage and the ozone bubbles are uniformly dispersed.

8 Claims, 5 Drawing Sheets

METHOD AND APPARATUS FOR PRODUCING ICE CONTAINING OZONE

TECHNICAL FIELD

The present invention relates to a method and an apparatus for producing ice containing ozone used for refrigeration of perishable foods such as fresh fish and vegetables.

BACKGROUND ART

Ozone has sterilization, disinfection, and deodorization effects due to its high oxidation power, and also has the property of decomposing into oxygen to become harmless as time passes. Accordingly, ozone is effective for preservation of perishable foods, purification of water, etc. However, since ozone easily decomposes into oxygen, ozone has a drawback that it cannot be stored for a long period of time. Thus, ice containing ozone has been produced by cooling down and freezing ozonated water in which ozone is dissolved in a high concentration.

For example, Publication of Examined Japanese Patent Application No. 08-27111 discloses a method for producing ice containing ozone, wherein ozonated water is sealed in a bag made of synthetic resin unreactive to ozone, and the bag containing the ozonated water is quick-frozen to produce ice containing ozone.

Furthermore, Japanese Laid-Open Patent Publication No. 2000-39239 discloses an apparatus for producing ice containing ozone. The apparatus includes an ozonated water manufacturing device for producing water containing ozone; an ozonated water packing device for filling vessels made of a resin with the ozonated water produced by the ozonated water manufacturing device through a water filling pipe, and for sealing water supply ports disposed at the vessels; and an ice making device for immersing packages in which the ozonated water is housed and sealed by the ozonated water packing device in liquid refrigerant, and for successively conveying the packages to make ice from the ozonated water in the resin vessels.

Still furthermore, Japanese Laid-Open Patent Publication No. 09-105570 discloses an apparatus for manufacturing ice containing ozone, wherein ozonated water is injected into a freezing cylinder provided with an auger so as to freeze the ozonated water, and ice containing ozone produced on an inner wall of the freezing cylinder is shaved using the auger.

Yet furthermore, Japanese Laid-Open Patent Publication No. 10-267476 discloses a method for manufacturing ice containing ozone. In the method, ozonated water is brought into contact with a member having a smooth surface cooled to 0° C. or less to generate ice containing ozone, the ice containing ozone is forcibly scraped off to manufacture cracked or foil-shaped ice, and a mixture of the ice pieces and water or the ice pieces and the ozonated water is cooled down to obtain block-shaped ice containing ozone.

However, the conventional methods for producing ice containing ozone have problems to be solved as follows.

In the arts disclosed in Publication of Examined Japanese Patent Application No. 08-27111 and Japanese Laid-Open Patent Publication No. 2000-39239, the ozonated water is fed into the container, and the container is cooled down in the coolant to form ice containing ozone. This brings about problems that the apparatus is complicated in structure and increased in size, and that production of the ice containing ozone requires a great deal of time and work.

In the arts disclosed in Japanese Laid-Open Patent Publication Nos. 09-105570, 10-267476, the ozonated water is cooled down to produce the ice containing ozone, the ice is scraped off into the ice pieces, and furthermore, the ice pieces are formed into the block-shaped ice containing ozone. This causes a problem that it takes time and labor to manufacture the ice containing ozone. Another problem is that ozone bubbles generated in the cooling step are emitted from the ozonated water into the air, and thereby less ozone is enclosed in the ice containing ozone.

DISCLOSURE OF THE INVENTION

The present invention has been made to overcome the above problems, and accordingly an object of the invention is to provide a method and an apparatus for producing ice containing ozone in which ozone is sealed in a higher percentage and ozone bubbles are uniformly dispersed.

The first aspect of the present invention in accordance with the object provides a method for producing ice containing ozone, comprising: a step of injecting ozonated water in which ozone is dissolved or suspended into a cylindrical-shaped container provided with an airtight lid at one side of the container, and a step of cooling down the ozonated water injected into the cylindrical-shaped container in a pressurized state to generate finer bubbles containing the ozone by freezing the ozonated water.

The second aspect of the present invention provides a method for producing ice containing ozone according to the first aspect of the invention, wherein the ozone is dissolved in the water in a saturated state or in a substantially saturated state.

The third aspect of the present invention provides a method for producing ice containing ozone according to the first and the second aspects of the invention, wherein pressurization of the ozonated water is carried out by forcibly injecting at least one of water in which the ozone or oxygen is dissolved, oxygen, and ozone into the container.

The fourth aspect of the present invention provides a method for producing ice containing ozone according to the first to the third aspects of the invention, wherein the pressurization of the ozonated water is carried out at a pressure ranging from greater than 0 to 10 kgf/cm$^2$, preferably from 1 to 9 kgf/cm$^2$, further preferably from 5 to 7 kgf/cm$^2$. If no pressure is applied to the ozonated water, ozone solubility in the ozonated water cannot be enhanced. On the contrary, if the pressure applied to the ozonated water exceeds 10 kgf/cm$^2$, pressure-resistant apparatus is required, and furthermore, the ozone solubility in the ozonated water does not significantly increase.

The fifth aspect of the present invention provides a method for producing ice containing ozone according to the first to the fourth aspects of the invention, wherein the cylindrical-shaped container is cooled down from a top portion of the container to freeze the ozonated water located at an upper portion of the cylindrical-shaped container.

The sixth aspect of the present invention in accordance with the above object provides an apparatus for producing ice containing ozone, comprising: the cylindrical-shaped container disposed in an upright state with an openable and closable airtight lid at one side of the container, the cylindrical-shaped container having an inlet disposed at the one side or the other side of the container for injecting the ozonated water supplied by a pump, wherein the cylindrical-shaped container has a gas port provided at the upper portion of the container, the gas port being operable to discharge a gas in the container and to inject ozone or oxygen from an outside into an inside of the container.

Here, it is preferable that the cylindrical-shaped container is widened toward the one side (on which the airtight lid is disposed) from the other side since such a container allows the generated ice containing ozone to be easily removed.

Moreover, it is preferable that the cylindrical-shaped container has a plurality of cooling units disposed on an outer surface of the container at both upper and lower portions thereof to cool down the upper portion of the ozonated water with the upper cooling unit prior to cooling of a lower portion of the ozonated water with the lower cooling unit. According to the structure, the ice containing ozone formed by the upper cooling unit can prevent the ozone from being discharged out of the ice containing ozone when the ozonated water located in the lower portion of the cylindrical-shaped container is turned to the ice containing ozone. Since the ozonated water can be frozen by the lower cooling unit in the state, separated ozone can be trapped in the upper portion of the ozonated water. As a result, a larger amount of ozone can be sealed in the ice containing ozone.

The seventh aspect of the present invention provides an apparatus for producing ice containing ozone according to the sixth aspect of the invention, wherein a cross section of the cylindrical-shaped container is circular or rectangular.

In the method for producing ice containing ozone according to the first to the fifth aspects of the present invention, the ozonated water in which the ozone is dissolved or suspended is injected into the cylindrical-shaped container provided with the airtight lid at one side of the container, and the ozonated water injected into the cylindrical-shaped container is cooled down in a pressurized state to generate finer the bubbles containing the ozone by freezing the ozonated water. Thus, the bubbles containing the ozone in a compressed state can be sealed in the ice containing ozone produced by cooling the water, and thereby the ozone is released to carryout sterilization, disinfection, and deodorization when the ice melts.

According to Henry's law, the mass of a gas which will dissolve into a certain amount of solution at a given temperature is directly proportional to the pressure (partial pressure) of the gas. Namely, although ozone has limited solubility in water, the ozone solubility in water can be increased by pressurization. Thus, pressurization of the ozonated water allows the ozone solubility in the ozonated water to be enhanced. Also, cooling of the ozonated water allows the ozone solubility to be increased.

When the ozonated water (liquid) turns into the ice containing ozone (solid), the ozone solubility is decreased, and thereby the ozone is separated (gas particles are generated) from the ozonated water (solid-liquid interface). However, the separated ozone is reduced in volume by pressurization as defined by Ideal Gas Equation $V=nRT/P$, where V, n, R, T, P are the volume, number of moles, gas constant, temperature, and pressure, respectively. Accordingly, volume of the bubbles containing the ozone is reduced, and a pressure thereof is increased. Moreover, the separation of the ozone is restrained by the pressurization of the ozonated water. The ozone separated from the solid-liquid interface can dissolve in the ozonated water again because the ozone solubility in the ozonated water is enhanced by the pressurization of the ozonated water.

When the ozonated water is frozen, its volume is increased, and accordingly a pressure inside the cylindrical-shaped container is increased. Thus, a pressure of the ozonated water and the ozone solubility are further enhanced, and the ozone separated from the solid-liquid interface can dissolve in the ozonated water again.

Since the bubbles containing the ozone generated in the ice containing ozone are small in size, they can be readily incorporated into the ice containing ozone and be uniformly distributed in the ice containing ozone. Thus, the ozone can be gradually emitted by meltage of the ice. As a result, the ozone can be evenly released for a long period of time. In this manner, the ice containing ozone in which the ozone is enclosed in a higher percentage and the ozone bubbles are uniformly dispersed can be produced.

In the method for producing ice containing ozone according to the second aspect of the present invention, since the ozone is dissolved in the water in a saturated state or in a substantially saturated state, a greater amount of the ozone can be enclosed in the ice containing ozone.

In the method for producing ice containing ozone according to the third aspect of the present invention, since the ozonated water is pressurized by forcible injection of at least one of water in which ozone or oxygen is dissolved, oxygen, and ozone into the container, the pressure of the ozonated water and the ozone solubility can be enhanced.

In the method for producing ice containing ozone according to the fourth aspect of the present invention, the ozonated water is pressurized at a pressure ranging from greater than 0 to 10 $kgf/cm^2$, preferably from 1 to 9 $kgf/cm^2$, further preferably from 5 to 7 $kgf/cm^2$. Therefore, a larger amount of the ozone can be sealed in the ice containing ozone.

In the method for producing ice containing ozone according to the fifth aspect of the present invention, because the cylindrical-shaped container is cooled down from the top portion thereof to freeze the ozonated water located at the upper portion of the container, a lid of ice is formed. Thus, when the ozonated water turns into the ice containing ozone, the ice containing ozone formed in the upper portion of the ozonated water can prevent the ozone separated from the solid-liquid interface from being discharged out of the ice. As a result, a larger amount of ozone can be sealed in the ice containing ozone. Furthermore, when the ice containing ozone is made from the ozonated water with the lid of ice, self-expansion of the ice can be useful to enhance the pressure of the ozonated water to increase the ozone solubility in the water.

The apparatus for producing ice containing ozone according to the sixth and seventh aspects of the present invention includes the cylindrical-shaped container provided with the openable and closable airtight lid at one side of the container. The inlet is disposed at the one side or the other side of the cylindrical-shaped container for injecting the ozonated water supplied by the pump. The cylindrical-shaped container disposed in an upright state has the gas port provided at the upper portion thereof. The gas port allows the gas in the container to be discharged out of the container and the ozone or oxygen to be injected from the outside into the inside of the container. Therefore, by cooling down the ozonated water in the cylindrical-shaped container under pressure, it is possible to produce the ice containing ozone in which the bubbles containing the ozone produced by freezing the water are made finer. Furthermore, by producing the ice containing ozone under conditions that the ozonated water is compressed to increase the ozone solubility in the ozonated water and that the ozonated water is cooled down, the ozone can be sealed in the ice containing ozone in a higher ratio, and the ozone bubbles can be uniformly dispersed.

The ozonated water can be pressurized by injecting the ozonated water from the inlet of the ozonated water, or ozone or oxygen from the gas port; thus, the ice containing ozone is not polluted by nitrogen oxide etc. Besides, the gas in the cylindrical-shaped container can be easily discharged out of the container because the gas port is disposed at the upper portion of the container.

In the apparatus for producing ice containing ozone according to the seventh aspect of the present invention, the cylindrical-shaped container has the circular-shaped or rectangular-shaped cross section. In case that the cylindrical-shaped container has the circular-shaped cross section, the ice containing ozone grows toward a center of a circle radially when it is produced. Thus, the solid-liquid interface is reduced in area as the ice grows, and speed at which the ice is manufactured is not easily reduced. In case that the cylindrical-shaped container has the rectangular-shaped cross section, produced ice containing ozone is easy to handle since the ice can be readily placed side by side in rows.

DESCRIPTION OF THE PREFERRED EMBODIMENT

Figure 1:
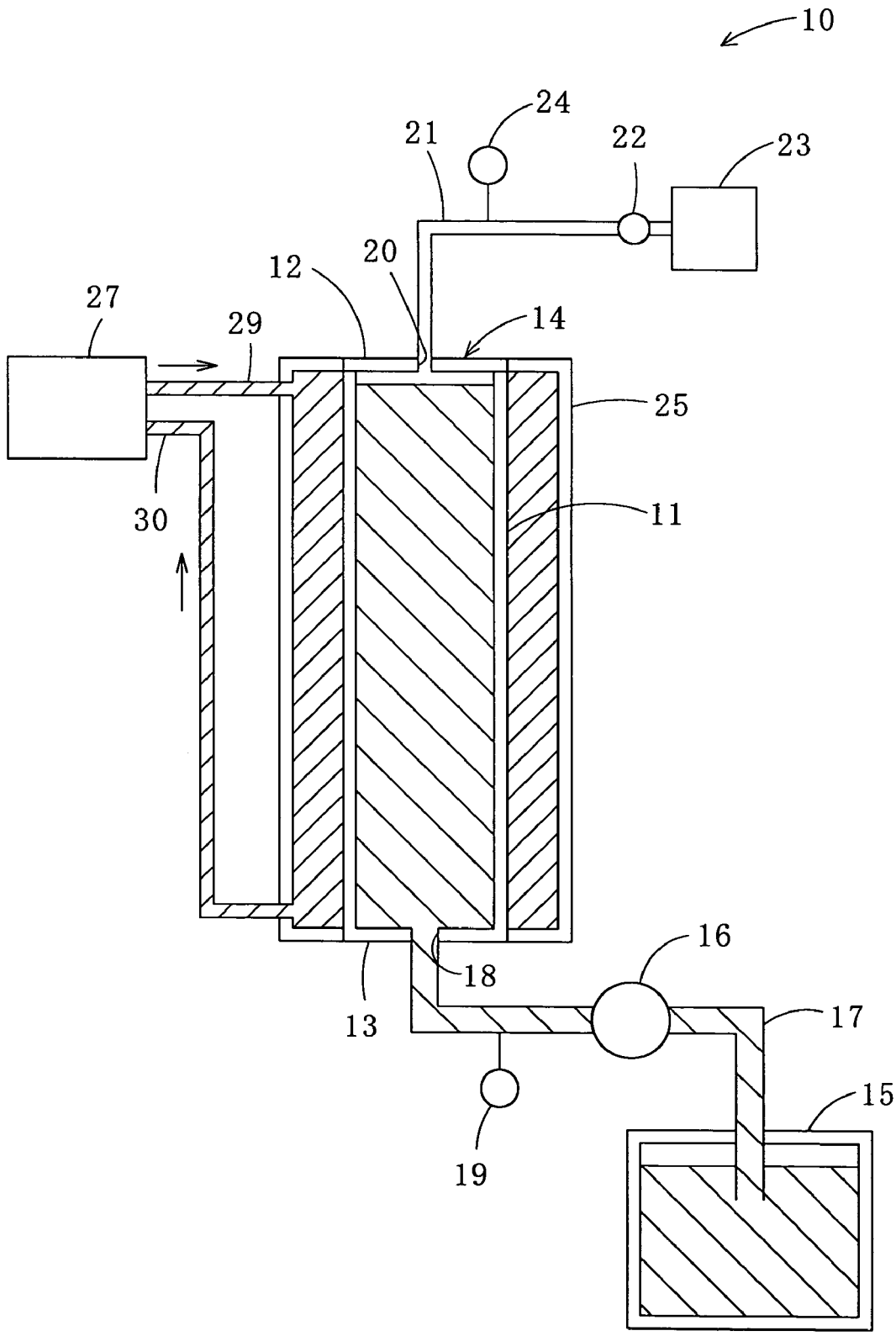
FIG. 1 is a descriptive view of an apparatus for producing ice containing ozone according to one embodiment of the present invention.
Figure 2:
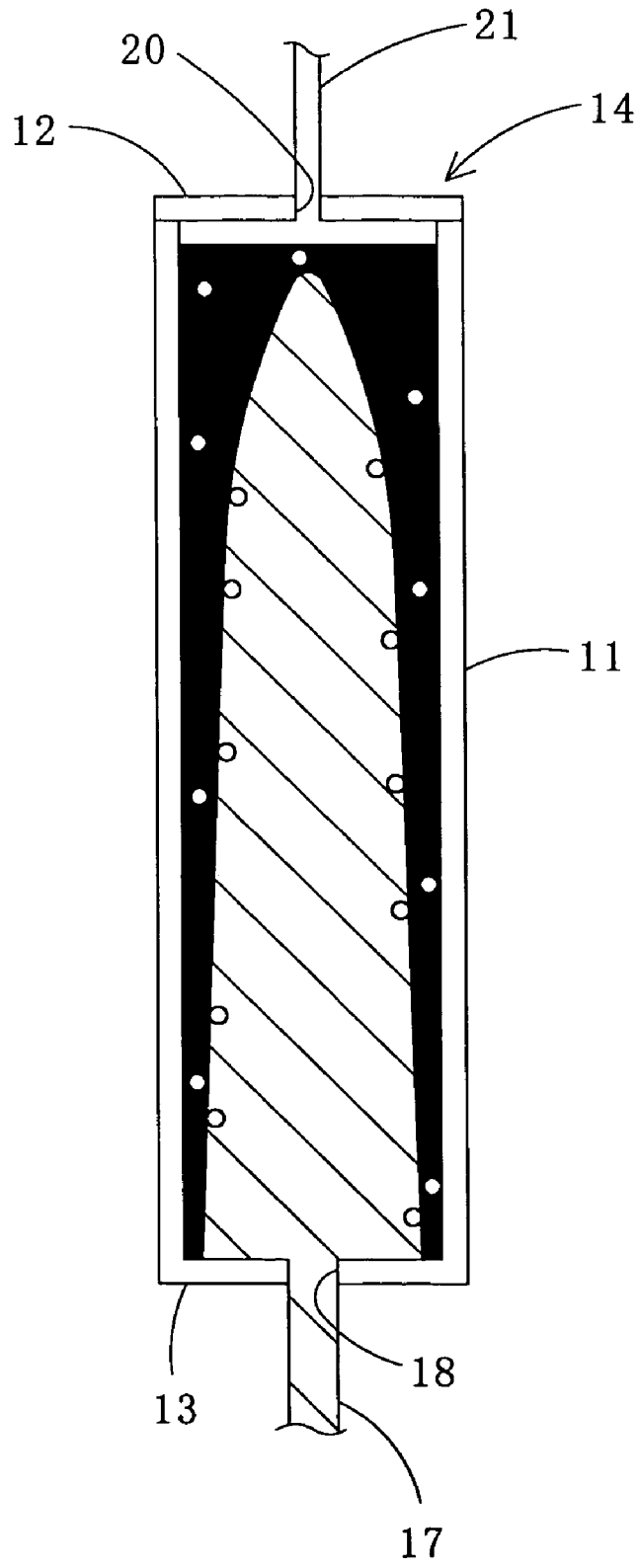
FIG. 2 is a descriptive view of a method for producing ice containing ozone using the apparatus for producing ice containing ozone.

Referring to FIGS. 1, 2, an apparatus 10 for producing ice containing ozone according to one embodiment of the present invention will be described hereinafter.

As illustrated in FIG. 1, the apparatus 10 for producing ice containing ozone has a cylindrical-shaped container 14 disposed in an upright state. The cylindrical-shaped container 14 includes a cylindrical-shaped body 11 having a rectangular-shaped cross section (or a square-shaped cross section) increased in size from a lower portion to an upper portion thereof, an airtight lid 12 openably and closably disposed at the upper portion of the cylindrical-shaped body 11, and a bottom plate 13 provided at the lower portion of the cylindrical-shaped body 11. The cylindrical-shaped container 14 may have a circular-shaped cross section.

The cylindrical-shaped container 14 is resistant to pressure, and is configured not to be deformed in case that ozonated water in the cylindrical-shaped container 14 is pressurized at, e.g., 10 kgf/cm$^2$, or in case that the ozonated water is cooled down to form ice containing ozone, and thereby its volume is increased.

An inlet 18 of the ozonated water is provided on the bottom plate 13 of the cylindrical-shaped container 14. The inlet 18 is communicated with a water reservoir 15 storing the ozonated water there in via a water supply pipe 17 having a pump 16 halfway. According to the structure, the ozonated water is supplied from the water reservoir 15 to the cylindrical-shaped container 14 by the pump 16.

Ozone is supplied from an ozone supplier (not shown) to the water reservoir 15, and water pre-stored in the water reservoir 15 is exposed to the ozone to produce the ozonated water in which the ozone is dissolved in a saturated state or in a substantially saturated state. The ozonated water can also be in a state that ozone bubbles are suspended therein. The water reservoir 15 is provided with a cooling device (not shown) operable to cool down the ozonated water. The water supply pipe 17 includes a water-pressure gauge 19 for measuring a pressure of the ozonated water supplied to the cylindrical-shaped container 14.

The airtight lid 12 of the cylindrical-shaped container 14 has a gas port 20 operable to discharge a gas in the cylindrical-shaped container 14, and to inject oxygen (or ozone) from an outside to an inside of the container 14. An oxygen cylinder 23 with a valve 22 is connected to the gas port 20 through a gas supply pipe 21. The gas supply pipe 21 is provided with a pressure gauge 24 for measuring a pressure of the oxygen inside the gas supply pipe 21.

The gas supply pipe 21 has a discharge port (not shown) for discharging the gas (e.g., air) in the cylindrical-shaped container 14 outside when the ozonated water is fed into the cylindrical-shaped container 14. The ozonated water in the cylindrical-shaped container 14 can be pressurized up to 10 kgf/cm$^2$ by supply of the oxygen to the container 14.

A cooling unit 25 is provided around an exterior of the cylindrical-shaped container 14. The cooling unit 25 is formed in an annular shape along an outer surface of the cylindrical-shaped container 14, and is supplied with coolant cooled down by a freezing machine 27.

Coolant pipes 29, 30 connected to the freezing machine 27 are respectively fixed to upper and lower portions of the cooling unit 25. The coolant cooled down in the freezing machine 27 is fed to the upper portion of the cooling unit 25 through the upper coolant pipe 29, and the coolant is further conveyed from the lower portion of the cooling unit 25 to the freezing machine 27 through the coolant pipe 30. Thereby, the cooling unit 25 is operable to cool down the ozonated water in the cylindrical-shaped container 14 downwardly from a top portion thereof. In this manner, the coolant is supplied to the cooling unit 25 circulately.

Next, a method for producing ice containing ozone according to one embodiment of the present invention using the apparatus 10 for producing ice containing ozone will be explained.

First, the ozonated water produced in the water reservoir 15 is supplied to the cylindrical-shaped container 14 from the inlet 18 of the ozonated water disposed at the bottom plate 13 of the container 14 by actuating the pump 16. The gas (air) in the cylindrical-shaped container 14 is discharged out of the container 14 via the gas port 20 and the discharge port provided on the gas supply pipe 21. The ozonated water is supplied to the cylindrical-shaped container 14 until a scale of the water-pressure gauge 19, i.e., the pressure in the container 14 reaches, for example, 3 kgf/cm$^2$.

Then, the valve 22 is opened to feed the oxygen in the oxygen cylinder 23 from the gas port 20 disposed at the airtight lid 12 of the cylindrical-shaped container 14 to the cylindrical-shaped container 14 via the gas supply pipe 21. The pressure in the cylindrical-shaped container 14 is regulated to be greater than 0 to 10 kgf/cm$^2$, e.g., 7 kgf/cm$^2$. An oxygen layer is formed in the upper portion of the cylindrical-shaped container 14 by the supply of the oxygen.

Alternatively, pressurization of the ozonated water in the cylindrical-shaped container 14 may be carried out as follows. The airtight lid 12 is opened, and the ozonated water is supplied to the cylindrical-shaped container 14 through the inlet 18. Then, the airtight lid 12 is closed to feed the ozonated water from the water reservoir 15 to the container 14 via the pump 16 or to feed the oxygen from the oxygen cylinder 23 to the container 14.

In this instance, the ozone solubility in the ozonated water in the cylindrical-shaped container 14 is increased by pressurization as defined in Henry's law. Accordingly, the ozone solubility in the ozonated water can be enhanced by pre-pressurization of the ozonated water. Thus, if the ozone is separated from the solid-liquid interface when the ozonated water is cooled down to form the ice containing ozone, the separated ozone can dissolve in the ozonated water again. Since the ozonated water is under pressure, it is difficult for the ozone in the ozonated water to separate from the solid-liquid interface as a gas.

Furthermore, the ozone solubility in the water can be increased by cooling of the ozonated water. Thus, it is preferable that the ozonated water in which the ozone is dissolved in a high concentration is produced by cooling down an inside of the water reservoir 15 with the cooling device (not shown) to lower a temperature of the water stored in the water reservoir 15, and by supplying the ozone with the ozone supplier (not shown) to expose the ozone to the water.

The coolant is supplied from the freezing machine 27 to the cooling unit 25 via the coolant pipe 29. As illustrated in FIG. 2, the ozonated water located at the upper portion of the cylindrical-shaped container 14 is cooled down to form ice by the coolant fed to the upper portion of the cooling unit 25 from the coolant pipe 29, and thereby the lid of the ice containing ozone is formed. When the ozonated water is cooled to make the ice, the ozone solubility is reduced, and accordingly the ozone is separated out from the ozonated water with the ozone dissolved therein in a saturated or substantially saturated state at the solid-liquid interface as a gas.

The gas (bubbles) is reduced in diameter and is made finer by pressurization of the ozonated water. Since the gas does not move upward in the ozonated water, the gas stays on the solid-liquid interface, and is further sealed in the ice containing ozone when the ozonated water around the gas is cooled down to form the ice. Even if the gas containing the ozone ascends in the ozonated water, the ascending bubbles are enclosed in the ice containing ozone because the lid of ice has been formed in the upper portion of the ozonated water.

Furthermore, the ozonated water in the cylindrical-shaped container 14 at the lower portion thereof is also cooled down by the coolant supplied to the cooling unit 25, and accordingly the ice containing ozone is manufactured. When the ozonated water turns into the ice containing ozone, the ozonated water is increased in volume. The self-expansion of the ozonated water allows the pressure of the ozonated water to be further enhanced. The ozone separated from the ice containing ozone at the time of the ozonated water becoming the ice is reduced in volume in the ozonated water by pressurization (according to Ideal Gas Equation $V=nRT/P$). At the same time, size of the bubbles is reduced, and a pressure thereof is increased.

After the ice containing ozone is produced, the airtight lid 12 is opened, and the pump 16 is activated to inject the ozonated water into the cylindrical-shaped container 14 so that the ice containing ozone is pushed out of the cylindrical-shaped container 14. Here, the cylindrical-shaped container 14 is widened from the lower portion (the bottom plate 13 side) to the upper portion thereof (the airtight lid 12 side), thereby facilitating the removal of the ice from the container 14. As an alternative, the cylindrical-shaped container may be a tubular-shaped container which is not broadened from one side to the other side. As a further alternative, the airtight lid may be disposed on a bottom portion of the cylindrical-shaped body to push the produced ice containing ozone out of the cylindrical-shaped container by supplying the oxygen from the oxygen cylinder.

When the ice containing ozone produced in the above method melts, the compressed ozone is released to carry out sterilization, disinfection, and deodorization. Moreover, the ozone can be gradually emitted as the ice containing ozone melts, since the bubbles containing the ozone generated in the ice containing ozone are uniformly distributed. Namely, the ozone can be emitted for a long period of time evenly.

EXPERIMENTAL EXAMPLE

Figure 3:
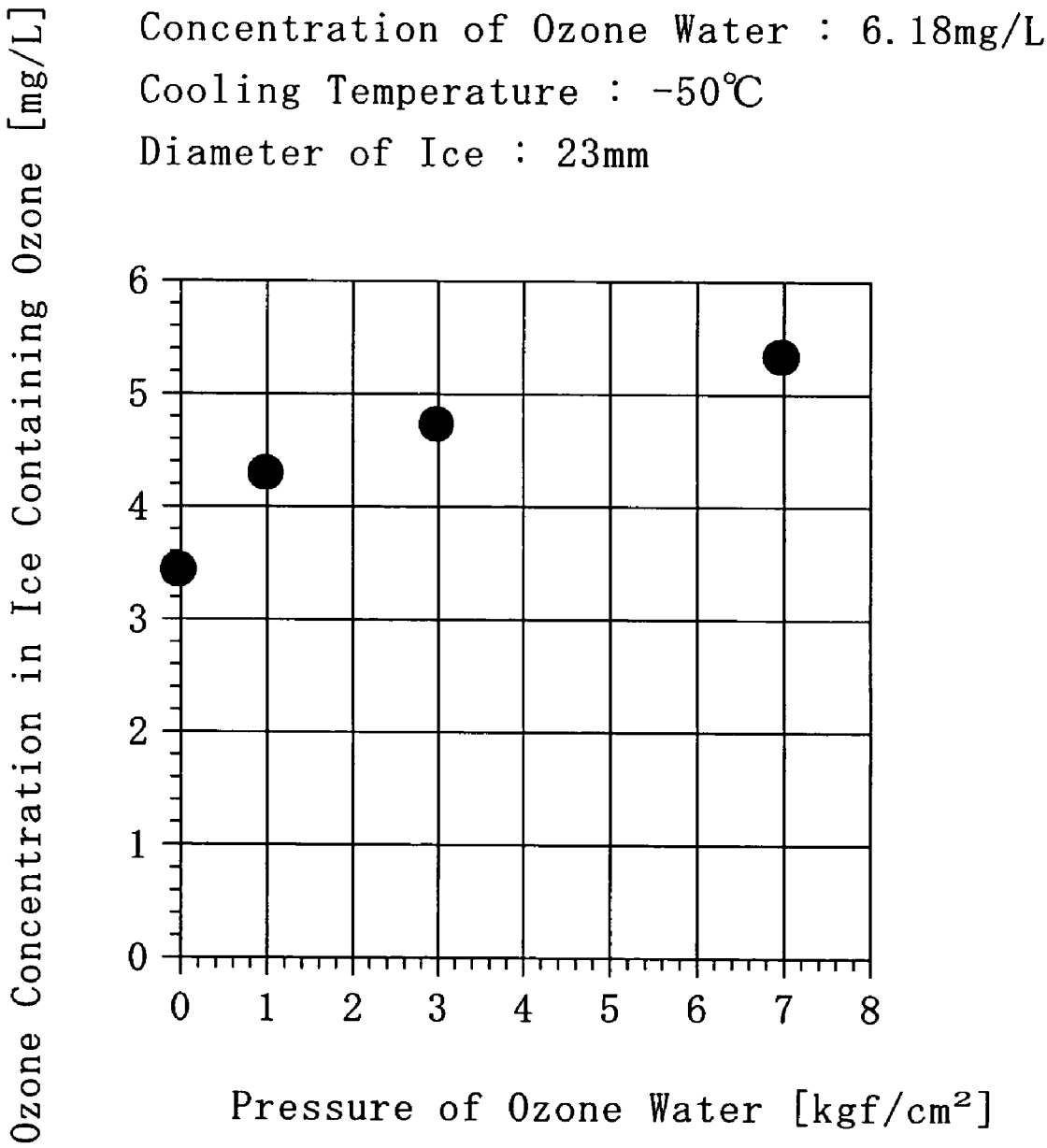
FIG. 3 is a graph illustrating pressures of ozonated water and ozone concentrations in ice containing ozone.

As illustrated in FIG. 3, ozone concentrations of ice containing ozone produced by cooling down ozonated water under each pressure of 0, 1, 3, 7 kgf/cm$^2$ in the apparatus for producing ice containing ozone were measured. A circular cylindrical-shaped container having an internal diameter of 23 mm and a length of 200 mm was used as the cylindrical-shaped container.

The ozonated water in which 6.18 mg/L (15° C.) of ozone was dissolved was cooled down to −50° C. under each of the above pressures to produce columnar-shaped ice containing ozone having a diameter of 23 mm, a length of some 200 mm, and a volume of 83.1 cm$^3$. The ozone concentrations in the ice containing ozone were measured by iodimetry ("Ozone Concentration Measurement Guidelines for Ozone Generator" published by Japan Ozone Association).

When the pressure applied to the ozonated water was 0 kgf/cm$^2$, volume of ozone in ice containing ozone was 0.285 mg. Namely, an ozone concentration of the ice containing ozone was 3.43 mg/L, which showed that approximately 56% of the ozone contained in the original ozonated water having the ozone concentration of 6.18 mg/L was sealed in the ice. When the pressure was 7 kgf/cm$^2$, volume of ozone in ice containing ozone was 0.445 mg. Namely, an ozone concentration of the ice containing ozone was 5.37 mg/L, which showed that approximately 87% of the ozone contained in the original ozonated water was sealed in the ice. This shows that the percentage of the ozone sealed in the ice containing ozone is increased by pressurizing the ozonated water.

Figure 4:
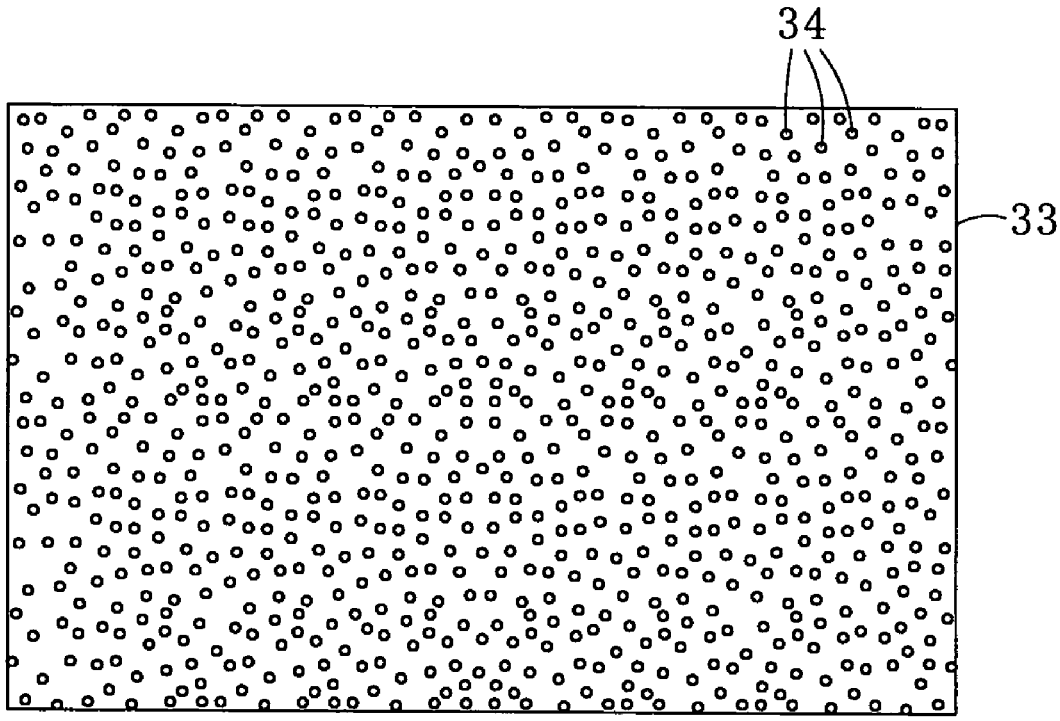
FIG. 4 is a descriptive view illustrating a state of gas bubbles in the ice containing ozone produced in the apparatus for producing ice containing ozone according to one embodiment of the present invention.

As illustrated in FIG. 4, bubbles 34 containing ozone are fine and uniform in ice 33 containing ozone which is produced by pressurizing the ozonated water at 1 kgf/cm$^2$. Here, since the bubbles 34 are compressed, when the ice 33 containing ozone melts, the ozone is rapidly emitted to carry out sterilization, disinfection, and deodorization extensively. Furthermore, the ozone can be released by degrees because the ozone is evenly distributed in the ice 33 containing ozone. Accordingly, the ozone can be emitted evenly for a long period of time.

Figure 5:
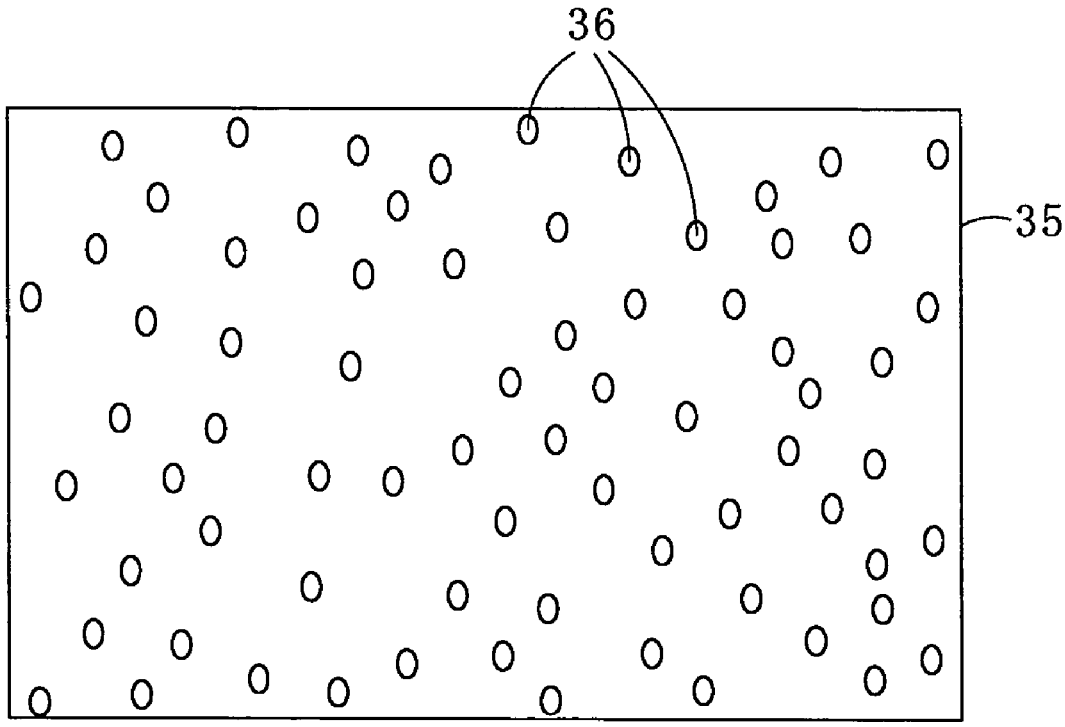
FIG. 5 is a descriptive view illustrating a state of gas bubbles in ice containing ozone produced in an apparatus for producing ice containing ozone according to prior art.

As illustrated in FIG. 5, ice 35 containing ozone produced without applying pressure has interspersed large bubbles 36. The bubbles 36 are not compressed, and ozone is nonuniformly distributed in the ice 35 containing ozone. Thus, the ozone is not emitted quantitatively when the ice 35 containing ozone melts.

The present invention is not limited to the above-mentioned embodiment, and modifications may be embodied in other specific forms without departing from the scope or spirit of the invention. For example, the methods and apparatus for producing ice containing ozone constituted by incorporating a part or whole of modified embodiments are included in the scope of the invention.

For example, in the apparatus for producing ice containing ozone according to the above embodiment, the ozonated water in the cylindrical-shaped container is pressurized by forcibly injecting the oxygen or the ozonated water into the container. Alternatively, pressurization of the ozonated water may be carried out by forcibly injecting at least one of water in which ozone or oxygen is dissolved, oxygen, and ozone. Therefore, the device for forcibly injecting oxygen or ozone disposed at the cylindrical-shaped container may be omitted. In this case, after the ozonated water is supplied to the cylindrical-shaped container, the ozonated water may be pressurized by further feeding the ozonated water into the cylindrical-shaped container with the pump so that the pressure of the ozonated water reaches a certain level. In the above-mentioned embodiment, the ozonated water is supplied to the cylindrical-shaped container from the bottom plate disposed at the lower portion of the container. Alternatively, the ozonated water may be supplied to the container from the upper portion thereof.

In the embodiment, the airtight lid is disposed at the upper portion of the cylindrical-shaped container. Alternatively, the airtight lid may be disposed at the lower portion of the cylindrical-shaped body. In the alternative, it is preferable that the cylindrical-shaped body is widened from the upper portion to the lower portion thereof for facilitating removal of the ice containing ozone. Further in the alternative, when the ice containing ozone is removed from the cylindrical-shaped container, the oxygen from the oxygen cylinder may be fed into the cylindrical-shaped container from the opposite side of the airtight lid to push the ice out of the container.

In the embodiment, the cylindrical-shaped container is provided with one cooling unit. Alternatively, two or more of cooling units may be provided at the upper and lower portions of the cylindrical-shaped container. In the alternative, the bubbles containing the ozone can be dispersed more evenly in the ice containing ozone by cooling down the cylindrical-shaped container sequentially from the cooling unit disposed at the upper portion. Furthermore, the shapes of the container and its cross section are not limited to the above-stated embodiment. Alternatively, the cross section of the container may have an oval shape, a triangular shape, or a polygonal shape of a pentagon or more. Further alternatively, the container may have a columnar shape, a cone shape, or a frustum shape.

Furthermore, the water supply pipe for feeding the ozonated water may be provided with one or more of a relief, accumulator, safety valve, etc. Still furthermore, a cutter may be provided above the cylindrical-shaped container. In this case, when produced ice containing ozone is pushed out of the cylindrical-shaped container, the ice containing ozone may be projected from the container at a given height, and the projected portion of the ice is cut by the cutter. Yet furthermore, a device for crushing produced ice containing ozone may be provided. Crushed ice containing ozone has larger surface areas, thereby releasing a greater amount of ozone.

In the apparatus for producing ice containing ozone according to the above embodiment, the ozonated water is cooled down to produce the ice containing ozone. Alternatively, ice containing an alternative gas to ozone such as carbon dioxide and oxygen may be manufactured.

In order to produce ice which contains carbon dioxide (carbon dioxide-containing ice), water in which carbon dioxide is dissolved or suspended (carbon dioxide water) is supplied to the apparatus for producing ice containing ozone, the water is pressurized by forcibly injecting at least one of the carbon dioxide water and carbon dioxide into the container, and then the water is cooled down. When the carbon dioxide-containing ice is put into water such as whisky and water, the ice pops with sound, thereby giving you a refreshing feeling.

In order to produce ice which contains oxygen (oxygen-containing ice), water in which oxygen is dissolved or suspended (oxygenated water) is fed to the apparatus for producing ice containing ozone, the water is pressurized by forcibly injecting at least one of the oxygenated water and oxygen into the container, and then the water is cooled down. The oxygen-containing ice can supply oxygen to a pond or the like.

What is claimed is:

1. A method for producing ice containing ozone, comprising:

a step of injecting ozonated water in which ozone is dissolved or suspended into a cylindrical-shaped container provided with an airtight lid at one side of the container, and a step of cooling down the ozonated water injected into the cylindrical-shaped container in a pressurized state to generate finer bubbles containing the ozone and enclose the bubbles in ice by freezing the ozonated water.

2. A method for producing ice containing ozone as defined in claim 1, wherein the ozone is dissolved in the water in a saturated state or in a substantially saturated state.

3. A method for producing ice containing ozone as defined in claim 1, wherein pressurization of the ozonated water is carried out by forcibly injecting at least one of water in which the ozone or oxygen is dissolved, oxygen, and ozone into the container.

4. A method for producing ice containing ozone as defined in claim 3, wherein the pressurization of the ozonated water is carried out at a pressure ranging from greater than 0 to 10 $kgf/cm^2$, preferably from 1 to 9 $kgf/cm^2$, further preferably from 5 to 7 $kgf/cm^2$.

5. A method for producing ice containing ozone as defined in claim 1, wherein the cylindrical-shaped container is cooled down from a top portion of the container to freeze the ozonated water located at an upper portion of the cylindrical-shaped container.

6. A method for producing ice containing ozone as defined in claim 4, wherein the cylindrical-shaped container is cooled down from a top portion of the container to freeze the ozonated water located at an upper portion of the cylindrical-shaped container.

7. An apparatus for producing ice containing ozone, comprising:

a cylindrical-shaped container disposed in an upright state with an openable and closable airtight lid at one side of the container, the cylindrical-shaped container having an inlet disposed at the one side or the other side of the container for injecting ozonated water supplied by a pump, wherein the cylindrical-shaped container has a gas port provided at an upper portion of the container and a cooling unit provided around an exterior of the container, the gas port being operable to discharge a gas in the container and to inject ozone or oxygen from an outside into an inside of the container, and the ozonated water injected into the cylindrical-shaped container in a pressurized state is frozen to generate finer bubbles containing the ozone and enclose the bubbles in ice.

8. An apparatus for producing ice containing ozone as defined in claim 7, wherein a cross section of the cylindrical-shaped container is circular or rectangular.

* * * * *